US012017274B2

(12) United States Patent
Andersson et al.

(10) Patent No.: US 12,017,274 B2
(45) Date of Patent: Jun. 25, 2024

(54) METHOD FOR MANUFACTURING A STEEL INGOT

(71) Applicant: OVAKO SWEDEN AB, Hofors (SE)

(72) Inventors: Jan-Erik Andersson, Falun (SE); Joakim Fagerlund, Tungelsta (SE)

(73) Assignee: OVAKO SWEDEN AB, Hofors (SE)

( * ) Notice: Subject to any disclaimer, the term of this patent is extended or adjusted under 35 U.S.C. 154(b) by 86 days.

(21) Appl. No.: 17/439,860

(22) PCT Filed: Mar. 20, 2020

(86) PCT No.: PCT/EP2020/057771
§ 371 (c)(1),
(2) Date: Sep. 16, 2021

(87) PCT Pub. No.: WO2020/193404
PCT Pub. Date: Oct. 1, 2020

(65) Prior Publication Data

US 2022/0184690 A1 Jun. 16, 2022

(30) Foreign Application Priority Data

Mar. 22, 2019 (SE) ..... 1950360-6

(51) Int. Cl.
*B22D 7/00* (2006.01)
*B22D 18/06* (2006.01)
(Continued)

(52) U.S. Cl.
CPC ..... *B22D 7/00* (2013.01); *B22D 18/06* (2013.01); *B22D 27/02* (2013.01); *C22C 38/02* (2013.01); *C22C 38/04* (2013.01); *C22C 38/18* (2013.01)

(58) Field of Classification Search
CPC ..... B22D 7/00; B22D 18/06; B22D 27/02
(Continued)

(56) References Cited

U.S. PATENT DOCUMENTS 9,234,252 B2 1/2016 Li et al.
2003/0172773 A1 9/2003 Sato et al.
(Continued)

FOREIGN PATENT DOCUMENTS

CN 102808062 A 12/2012
CN 103924030 B 5/2015
(Continued)

OTHER PUBLICATIONS

Dong, Xiao-liang et al., Application of Vacuum Carbon Deoxidation Purification Technologies to Manufacturing Large Steel Ingots, Foundry, vol. 62, No. 9, pp. 843-845 (Sep. 2013), including English Abstract.

(Continued)

*Primary Examiner* — Kevin P Kerns
(74) *Attorney, Agent, or Firm* — Porter Wright Morris & Arthur LLP

(57) ABSTRACT

A method for manufacturing a steel ingot in a casting arrangement employs a vacuum vessel; an ingot mold arranged within the vacuum vessel, and a stirrer arranged to stir liquid steel in the ingot mold. The method employs the following steps: providing a liquid steel melt; filling the ingot mold with the liquid steel melt; applying a reduced pressure within the vacuum vessel; allowing the liquid steel melt to solidify into an ingot; and allowing the liquid steel melt to solidify under stirring within the ingot mold at a reduced pressure during solidification of the steel melt. The liquid steel melt includes a predetermined amount of carbon and; incidental impurity elements in the form of oxides. During stirring, the oxides are reduced by carbothermic reaction in which oxygen in the oxides and carbon in the steel melt form carbon-monoxide.

17 Claims, 3 Drawing Sheets

(51) Int. Cl.

| | |
|---|---|
| ***B22D 27/02*** | (2006.01) |
| ***C22C 38/02*** | (2006.01) |
| ***C22C 38/04*** | (2006.01) |
| ***C22C 38/18*** | (2006.01) |

(58) Field of Classification Search
USPC ..... 164/499, 61, 253
See application file for complete search history.

(56) References Cited

U.S. PATENT DOCUMENTS

| | | | | |
|---|---|---|---|---|
| 2007/0272054 | A1 | 11/2007 | Pleschiutschnigg et al. | |
| 2009/0288794 | A1* | 11/2009 | Lynn | B22D 46/00 164/151.4 |
| 2012/0145353 | A1* | 6/2012 | Nakayama et al. | C22B 9/006 164/493 |

FOREIGN PATENT DOCUMENTS

| | | | |
|---|---|---|---|
| CN | 103611892 | B | 3/2016 |
| CN | 106282748 | A | 1/2017 |
| GB | 1192856 | A | 5/1970 |
| JP | H08-334483 | A | 12/1996 |
| RU | 2100142 | C1 | 12/1997 |

OTHER PUBLICATIONS

Kang, Wei Cai et al. Effect of vacuum carbon deoxidation (VCD) process parameters on 3.5 NiCrMoV steel—Large Castings and Forgings, No. 04, pp. 6-12 (Apr. 30, 1996), cited in the Office Action from corresponding Chinese Application No. 202080022514.0 dated Nov. 28, 2022, as an "A" reference.

Official Office Action from corresponding Chinese Application No. 202080022514.0 dated Nov. 28, 2022.

Jin, Wenzhong et al., Research on vacuum-electromagnetic casting of IN100 superalloy ingots, Science and Technology of Advanced Materials, vol. 8, No. 1-2, pp. 1-4 (2007).

* cited by examiner

METHOD FOR MANUFACTURING A STEEL INGOT

TECHNICAL FIELD

The present disclosure relates to a method for manufacturing a steel ingot in a casting arrangement.

BACKGROUND ART

In conventional steelmaking, molten metal from the smelting furnace is usually poured into a ladle, from which the metal then is poured into vessels for further production steps. Molten metal may be poured from the lip at the top of the ladle when the ladle is of small capacity. When the ladle is larger, the metal is poured through a refractory nozzle at the bottom of the ladle. The nozzle can be closed from inside the ladle by a refractory stopper. Devices without stoppers are also widely used. Here, the ladle's nozzle is closed from the outside by a refractory plate. The plate, which has an orifice, can be moved so that the orifice coincides with the nozzle, thus allowing the metal to flow out.

In the ingot steel industry, molten steel is poured from a ladle into molds, The metal can be poured into the mold either from the top of the mold or from the bottom through a connecting channel. In the first case, the steel is poured from the ladle directly into the mold. After the mold is filled, the ladle opening is closed and the ladle is moved to the next mold, where the process is repeated. In bottom pouring, several molds can be filled with steel simultaneously. Here, the molds are mounted on a stool having channels lined with refractory bricks. The steel from the ladle descends through the fountain into the channels of the stool and then enters the mold from the bottom. The pouring method used depends on such factors as the steel's grade and weight and the intended use of the ingots.

Bottom pouring technique is the state-of-the-art in the steel industry today. Mainly because of easier filling where a number of molds can be filled simultaneously. Top filling, which was more commonly used 30 years ago, showed severe re-oxidation because of the exposure of the steel beam to air during teeming.

In bottom pouring, the steel will be exposed to ceramics in the runner bricks as well as in the trumpet (where the steel is poured into the bottom pouring system from the ladle). In order to control the re-oxidation of the steel entering the molds, a mold powder is used which should cover the steel surface during filling of the mold. To control the solidification, an exothermic plate is often used on top of the mold powder. Both the ceramics and the mold powder have a great tendency for re-oxidizing the steel due to the fact that they consist of less stable oxides and will be reduced by the steel. The increased oxygen content of the steel will result in formation of non-metallic inclusions in the form of oxides due to reaction between oxygen and alloying elements in the molten steel or impurities resulting from the slag or previous production steps.

The increasing demand in recent years for high quality steels has led to the continuous improvement of steelmaking practices. There is a special interest in the control of non-metallic inclusions due to their harmful effect on the subsequent stages and their great influence on the properties of the final steel product. The quality of the final product is not only determined by the strength or ductility of the steel but also controlled through the control of the amount, size and chemical composition of the inclusions. The control of the formation of non-metallic inclusions and the identification of their constituent phases are of extreme importance for the production of clean steels.

The cleanliness in steel is achieved through a wide range of operating practices which include the additions of deoxidizing agents and ferroalloys, the extent and sequence of secondary metallurgy treatments, stirring and transfer operations, shrouding systems, continuous casting procedure, the absorption capacity of the various metallurgical fluxes, and casting practices etc.

Carbon is a strong deoxidizer in steel and reacts with oxygen in the steel melt to form carbon monoxide (CO). The degree of deoxidization is limited by equilibrium conditions and at normal atmospheric pressure (1 bar) the equilibrium oxygen level is 20 ppm in a steel with 1 wt. % C. Conventionally, a deoxidation agent such as aluminum is therefore added in order to chemically bind more oxygen. This practice may reduce the oxygen level down to 3 ppm in the steel.

Steel exposed to vacuum will undergo a "cleaning effect", This is well known in the steel industry. This is mainly used in normal steelmaking procedure such as vacuum ladle treatment or RH degassing. Here, the vacuum is used mainly for making gases, such as hydrogen and nitrogen less soluble in the steel and will evaporate out into the vacuum reducing the amount of these gases in the steel. Vacuum is also used in various re-melting procedures such as VIM (Vacuum Induction Melting) or VAR (Vacuum Arc Remelting). The beneficial effect of using vacuum as a "cleaning procedure" is well established.

Some research has further been done on casting of super alloys under vacuum conditions. See for example, [Wenzhong Jin, Tingju Li, Guomao Yin: "Research on vacuum-electromagnetic casting of IN100 superalloy ingots", Science and Technology of Advanced Materials 8 (2007) 1-4. This article discusses a two-step manufacturing method of a super alloy in a VIM-furnace. In the first step the raw materials of the super alloy are melted and cast in the VIM furnace. In a second step the super alloy is remelted and cast in a steel mold in the VIM furnace and subjected to electromagnetic stirring under vacuum in the VIM furnace in order to refine the crystal structure of the super alloy.

In the production method described in the article, the two steps of melting-casting and re-melting-casting in an integrated VIM-process results in a more homogenous crystal structure. The method described in the article is intended for refining of the crystal structure but it does not discuss improvement of steel cleanliness. The described set-up is also not suitable for steel production on an industrial scale.

There is thus a need for an improved method for production of steel ingots.

Thus, it is an object of the present disclosure to provide a method for production of steel ingots that solves at least one of the problems of the prior-art.

In particular, it is an object of the present disclosure to provide a method for production of steel ingots that have a minimum amount of non-metallic inclusions.

Moreover, it is an object of the present disclosure to provide a method for production of steel ingots with a minimum amount of non-metallic inclusions that is suitable for industrial scale manufacturing.

SUMMARY OF THE INVENTION

According to the present disclosure, at least one of these objects is met by a method for manufacturing a steel ingot in a casting arrangement comprising a vacuum vessel; an ingot mold arranged within the vacuum vessel and a stirrer arranged to stir liquid steel in the ingot mold, comprising the steps of:

providing a liquid steel melt;

filling the ingot mold with the liquid steel melt;

applying a reduced pressure within the vacuum vessel;

allowing the liquid steel melt to at least partially solidify at a reduced pressure into an ingot, wherein the liquid steel melt is stirred within the ingot mold at a reduced pressure during at least a portion of the solidification of the steel melt; characterized in that, the liquid steel melt comprises a predetermined amount of carbon and;

incidental impurity elements in the form of oxides, wherein during stirring of the steel melt, the oxides are reduced by carbothermic reaction in which oxygen in the oxides and carbon in the steel melt for carbon-monoxide.

The main advantage of the method according to the present disclosure results is that it achieves a very high degree of removal of the incidental impurity elements in the steel melt. This is due to the strong effect carbon has on incidental impurity elements in the form of oxides at low pressures. Moreover, according to the present disclosure, cleaning of the steel takes place in the ingot mold, during solidification, and therefore no re-contamination can occur to the steel melt. An additional advantage in of removing incidental impurity elements in the ingot mold during solidification of the steel melt is that costly conventional steel making steps that earlier where performed prior to casting may be omitted.

According to the present disclosure, solidification of the steel melt is at least partially performed under reduced atmospheric pressure. That is, at a pressure lower than normal atmospheric pressure (approx. 1 bar at sea level). The steel melt may be allowed to completely solidified under reduced atmospheric pressure.

According to the present disclosure, by reducing the atmospheric pressure, the equilibrium between oxygen (bound in oxides) and carbon is altered in the steel melt and it is possible to reduce the oxygen level to very low levels. FIG. 1 shows a diagram over the equilibrium at 1600° C. between of oxygen and carbon in steel melts at varying content and at different atmospheric pressures (lines a, b and c) acting on the steel melt. As indicated in FIG. 1, it is possible to reach an oxygen content of 0.004 ppm in a 1% C steel melt by reducing the atmospheric pressure to 0.1 mbar (line c). This process is normally called carbothermic reaction and is schematically presented below. In the carbothermic reaction, carbon (C), which is dissolved in the steel melt, reduces solid oxides (MeO), which are contained in the steel melt, under the formation of carbon-monoxide gas (CO) and free oxide forming elements (Me). The carbon-monoxide leaves the steel melt as gas while the oxide forming elements (Me), in dependency of their vapor pressure, may dissolve in the steel melt or leave the steel melt as vapor.

$$\underline{C}+MeO \Leftrightarrow CO(g)+\underline{Me}$$

The oxide forming elements Me may be constituted of such elements that typically are used in steelmaking, for, as alloying elements or as elements of ceramic linings or elements of flux or in the form of incidental impurities. For example, the oxide forming elements Me may selected from the group consisting of Mg, Ca, Al, Si and Mn. Their oxides are thus MgO, CaO, $Al_2O_3$, $SiO_2$ and MnO.

According to the present disclosure the steel melt is stirred at reduced pressure during at least a portion of solidification of the steel melt in the ingot mold. As described above, it is theoretically possible to reach 0.004 ppm oxygen at an atmospheric pressure of 0.1 mbar. However, deoxidation may be limited by the ferrostatic pressure of the steel melt on the CO-bubbles that are formed in the reaction between carbon and oxygen in the steel melt. Namely, when carbon and oxygen reacts deep down in steel melt, the ferrostatic pressure of the steel melt will impede nucleation and growth of the CO-bubbles. By stirring the steel melt, the molten steel is constantly brought underneath the surface zone where the ferrostatic pressure is sufficiently low to facilitate CO-bubble formation.

The steel melt may thereby be stirred until the steel melt is essentially completely solidified into an ingot. Stirring may be initiated when the steel melt is essentially in liquid state in ingot mold. That is, shortly after pouring and/or application of the vacuum. Alternatively, the steel melt may be stirred during a period that lies between an essential completely liquid state and an essential completely solid state of the steel melt. The skilled person may determine suitable stirring times on basis of experience and/or experiments.

Preferably, the ingot mold is manufactured of steel, such as austenitic steel or cast iron, in order to prevent recontamination of the steel from the lining of the mold. Thus, the mold is free of any ceramic lining. In an alternative, the mold inner surface can be coated by a substance containing carbon in order to facilitate the carbothermic reaction.

A ceramic lining may decompose at low pressures which means that oxygen will enter the steel so that the cleaning effect of the carbothermic reaction cannot be fully utilized. However, in the method of the present disclosure cleaning of the steel take place in an inert steel in the mold. This makes it possible to use very low pressures, which is beneficial for the carbothermic reaction to occur.

The liquid steel melt may be manufactured outside, i.e. remote from the vacuum vessel. Manufacturing of the steel melt involves conventional steel making methods including: melting of steel raw material in an electric arc furnace; treatment of the molten steel in a converter and; adjustment of the steel composition in the ladle. By using existing conventional steel production equipment, the costs for producing the steel ingots according to the present disclosure are reduced.

In order to receive steel from a remote facility, the vacuum vessel may comprise a closable opening for allowing the mold to be filled with steel from a container outside the vacuum vessel.

Stirring of the steel melt in the mold may be achieved by an electromagnetic stirrer. The stirrer may be configured such that stirring of the liquid steel melt results in that liquid steel is transported in direction from the bottom of the mold towards the top of the mold and from the top of the mold towards the bottom of the mold. This facilitates the formation of CO-bubbles and thus reduces the oxygen level in the steel.

Preferably, one or more of the method steps are designed such that the content of oxides in the solidified ingot is below a predetermined threshold level. The content of the oxides may thereby be measured in parts per million (ppm). Measurement may be made by conventional methods. The threshold level for the oxide content in the steel melt may be less than or equal to 3 ppm or less than or equal to 0.3 ppm or less than or equal to 0.01 ppm. A low content of oxides results in improved mechanical properties of the solidified ingot and products produced therefrom.

The pressure in the vacuum vessel may thereby be less than 1 mbar. More preferred the pressure is 0.1 mbar or less. A lower pressure yields lower oxygen content, but extremely low pressure may be difficult to achieve under production conditions.

The initial temperature of the steel melt, i.e when poured into the ingot mould, may be 1650-1500° C., for example 1580-1500° C.

The steel melt may be based on Fe and may nominally comprise dissolved carbon in an amount of 0.01-1.3 wt %, for example 0.05-1.3 wt %. This amount is extremely large in comparison to the amount of impurities, nominally 3 ppm. Thus, there will always be sufficient carbon present to achieve reduction of oxides in the steel melt. In an example, the amount of carbon is 0.1-1.3 wt % in the steel melt.

The steel melt may comprise one or more of the following alloying elements (in wt %.):

Si: 0-3, preferably 0.05-3; Mn: 0 -3, preferably 0.05-3; Cr: 0-18, preferably 0.05-18; Ni: 0-10, preferably 0.05-10; V: 0-2, preferably 0.05-2; Mo: 0-3, preferably 0.05-3; N: 0-0.4, preferably 0.01-0.4.

Typically, the steel melt, prior to filling the mold, has an oxygen content from approximately 20 ppm to approximately 3 ppm.

The method may comprise an optional step of pre-deoxidizing the steel melt. The steel melt may thereby be pre-deoxidized prior to pouring the steel melt into the ingot mould or after. Pre-deoxidizing may be performed by conventional steel making methods such as addition of aluminum. After pre-deoxidation, the steel melt may have an oxygen content of approximate 3 ppm.

The present disclosure further relates to an object manufactured by the method disclosed hereinabove. The object may be a bar, wire, strip, tube, ring or plate.

The present disclosure further relates to use of the method disclosed hereinabove for manufacturing an ingot with low oxygen content. That is, an oxygen content lower than in the liquid steel prior to filling the ingot mold.

DETAILED DESCRIPTION OF EMBODIMENTS

The method for manufacturing a steel ingot according to the present disclosure will now be described more fully hereinafter. The method according to the present disclosure may however be embodied in many different forms and should not be construed as limited to the embodiments set forth herein. Rather, these embodiments are provided by way of example so that this disclosure will be thorough and complete, and will fully convey the scope of the present disclosure to those persons skilled in the art. Same reference numbers refer to same elements throughout the description.

Figure 1:
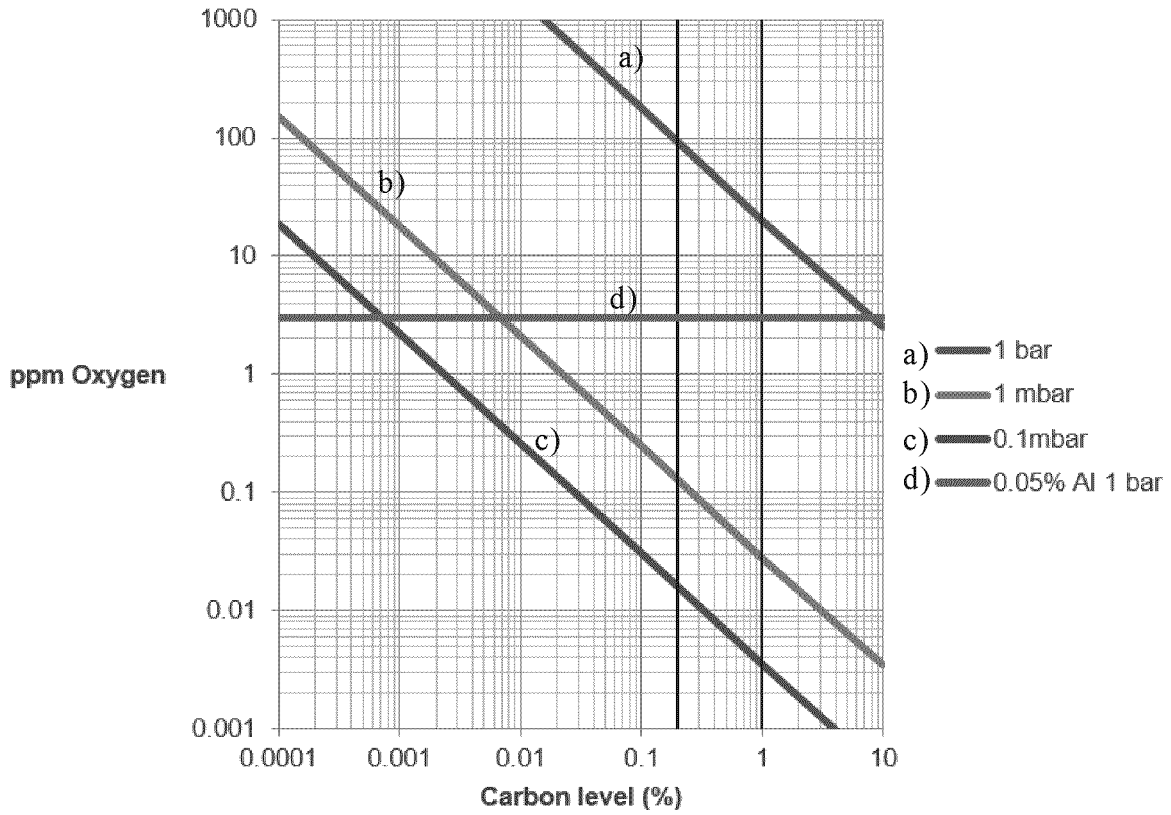
FIG. 1: A diagram showing equilibrium between oxygen and carbon at various atmospheric pressures.
Figure 2A:
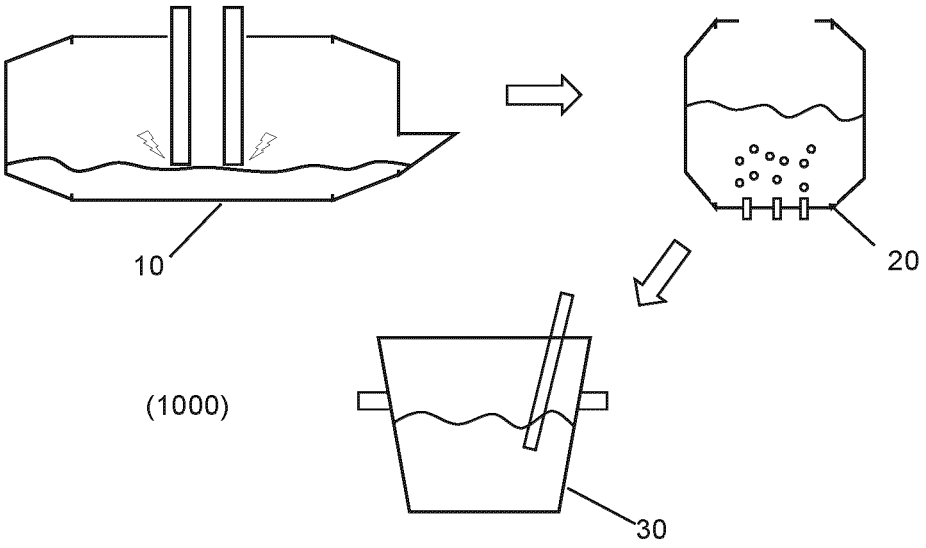
FIG. 2*a*-2*d*: Schematic drawings show the steps of the method of the present disclosure.

FIGS. 2*a* shows a first step 1000 of providing a steel melt. The steel melt may be produced by conventional steel making methods including melting steel raw material such as scrap metal in an electric arc furnace 10. The molten steel is poured into a ladle 20 for oxygen reduction and subsequently into a ladle 30 for refinement. The ladle 30 may provide a container for transporting the steel melt in the method according to the present disclosure. The total weight of the steel in the ladle 30 may be 20 tons or more.

Figure 2B:
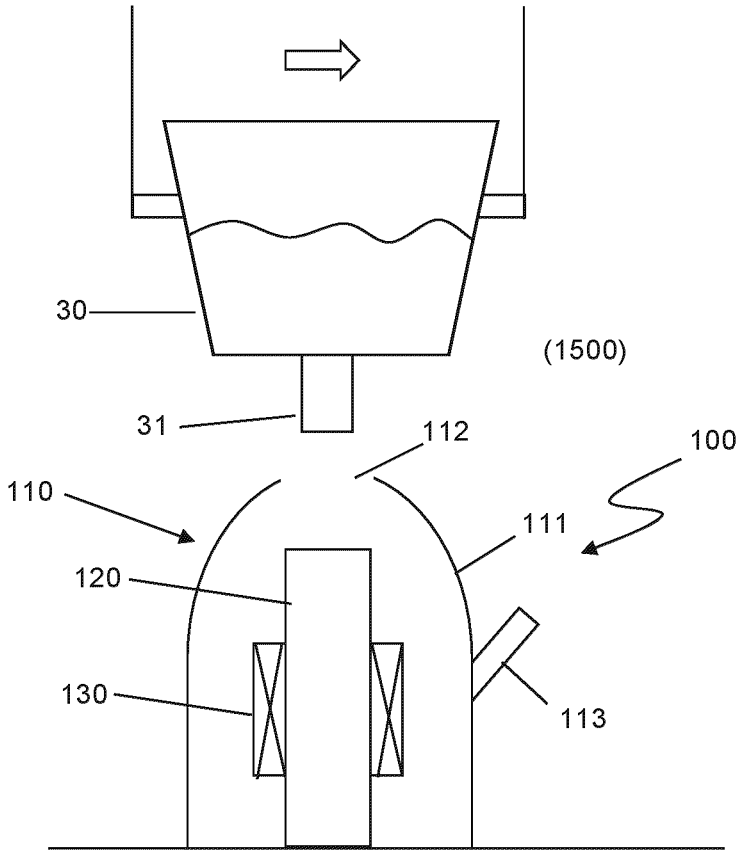

In a substep 1500, see FIG. 2*b*, the ladle 30 is transported to a casting arrangement 100 having a vacuum vessel 110, an ingot mold 120 arranged within the vacuum vessel and a stirrer 130 arranged to stir liquid steel in the ingot mold. The vacuum vessel may be manufactured from steel sheet and has a dome-shaped housing 111 which is arranged such that its interior may be completely air and gastight sealed off from the exterior. It is obvious that the vacuum vessel may have any suitable form. The vacuum vessel comprises a closable and airtight sealable opening 112 for allowing the mold to be filled with steel from the ladle outside the vacuum vessel.

The vacuum vessel further comprises a vacuum opening 113 which is connected to a vacuum pump (not shown) which allows the pressure within the vacuum vessel to be reduced.

The ingot mold 120 is manufactured of austenitic steel or cast iron in dimensions 600X600X2000 mm and is open at its top. Typically, the mold may accommodate ingots weighing 4.2 tons. It is possible to arrange more than one ingot mold within the vacuum vessel. The stirrer 130 may be an electromagnetic stirrer and may be arranged to circulate liquid steel from the bottom to the top of the mold and vice-versa. The stirrer may be strand stirrer of the ORC 1100/400M-series, which is commercially available from the company ABB.

The liquid steel in the ladle may have composition of C: 0.1%; Mn: 0.2%; Si 0.2%;Cr 1.5% and balance Fe. The oxygen content in the liquid steel may be approximately 3 ppm tied up as oxides.

Figure 2C:
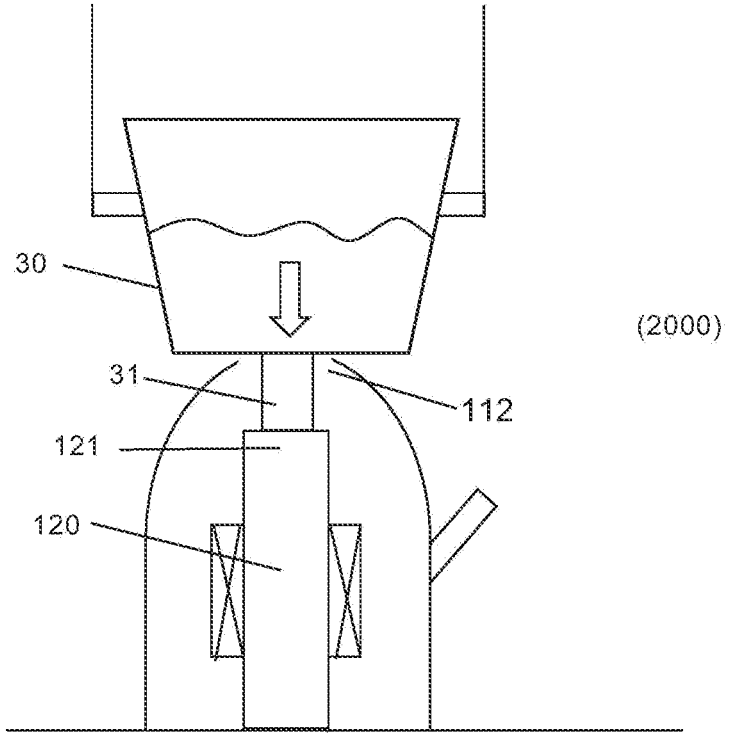

In a second step 2000, see FIG. 2*c*, the ingot mold 120 is filled with liquid steel melt. This may be achieved by positioned the ladle 30 above the closable opening 121 in the vacuum vessel, opening the closable opening and lowering the ladle such that its outlet tube 31 enters through the closable opening and into the top of the ingot mold 120. The steel in the ladle is then released through the outlet tube into the mold. When the mold is filled, the ladle is removed and the closable opening is closed.

Figure 2D:
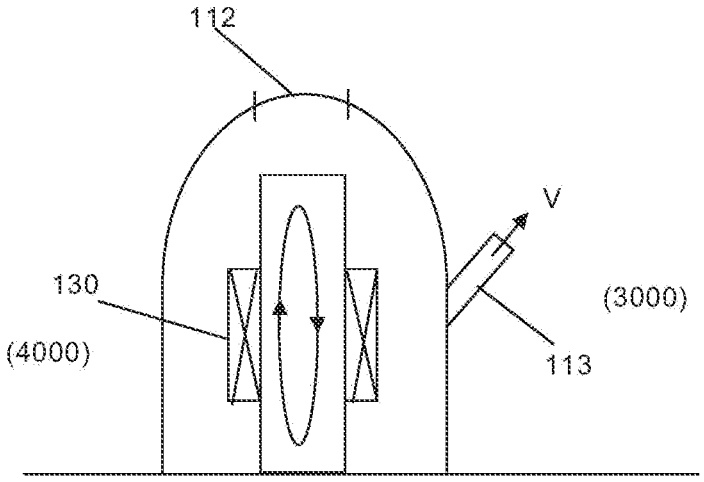

Subsequently, in a third step 3000, see FIG. 2*d*, the pressure is reduced in the vacuum vessel 110 by activating the vacuum pump (not shown). The pressure may be reduced to 0.1 mbar or less.

Next or simultaneous, in a fourth step 4000, the stirrer 130 is activated to circulate the liquid steel in the mold. Stirring is continued until at least a portion of the steel melt is solidified. For an ingot mold of the present dimension the time for complete solidification of the steel melt into an ingot may be 2 hours. During stirring, the oxygen content is reduced by reaction with carbon in the steel melt as described hereinabove. In the described embodiment, stirring is applied to the side of the ingot mold. However, it is possible to apply stirring to other positions. For example, to the upper part of the mold or on the top of the mold or the bottom of the mold. Stirring may also be applied to multiple positions of the mold.

In a subsequent step, not shown, the ingot is removed from the ingot mold. The ingot may subsequently be subjected to additional working steps such as heat treatment and forming by e.g. rolling, forging or drawing into objects such as bars, wires, strip, sheet or plates. These steps are not shown.

Although a particular embodiment has been disclosed in detail, this has been done for purpose of illustration only, and is not intended to be limiting. In particular it is contemplated that various substitutions, alterations and modifications may be made within the scope of the appended claims.

For example, the casting arrangement may be arranged such that the ingot mold may be filled with liquid steel while a reduced pressure prevails in the vacuum vessel 110. In an embodiment, this may be achieved by arranging a further vacuum chamber around the casting arrangement. Filling of the mold may be performed by: placing the ladle in the vacuum chamber, evacuating both vacuum chamber and vacuum vessel, filling the mold through the closable opening 112 and closing the opening.

The casting arrangement may be arranged such that the ingot mold may be filled with liquid steel while a reduced pressure prevails in the vacuum vessel 110. In an embodiment this may be achieved by arranging a further vacuum chamber around the casting arrangement. Filling of the mold may be performed by: placing the ladle in the vacuum chamber, evacuating both vacuum chamber and vacuum vessel, filling the mold through the closable opening 112 and closing the opening.

In another embodiment, the closable opening 112 may be provided with an air-lock.

It is also possible to combine the described alternatives.

Moreover, although specific terms may be employed herein, they are used in a generic and descriptive sense only and not for purposes of limitation. Furthermore, as used herein, the terms "comprise/comprises" or "include/includes" do not exclude the presence of other elements. Finally, reference signs in the claims are provided merely as a clarifying example and should not be construed as limiting the scope of the claims in any way.

The invention claimed is:

1. A method for manufacturing a steel ingot in a casting arrangement comprising a vacuum vessel; an ingot mold arranged within the vacuum vessel; and a stirrer arranged to stir liquid steel in the ingot mold, the method comprising the steps of:

providing a liquid steel melt;

filling the ingot mold with the liquid steel melt;

applying a reduced pressure within the vacuum vessel; and allowing the liquid steel melt to at least partially solidify at a reduced pressure into an ingot, wherein the liquid steel melt is stirred within the ingot mold at a reduced pressure during at least a portion of solidification of the steel melt;

wherein the ingot mold is manufactured of steel or cast iron;

the liquid steel melt is Fe-based and comprises a predetermined amount of carbon;

during stirring, incidental impurity elements in the form of oxides are reduced by carbothermic reaction in which oxygen in the oxides and carbon in the steel melt form carbon monoxide;

the step of providing the liquid steel melt includes manufacturing the liquid steel melt outside of the vacuum vessel; and the pressure within the vacuum vessel is ≤1 mbar.

2. The method according to claim 1, wherein the pressure within the vacuum vessel is ≤0.1 mbar.

3. The method according to claim 2, wherein the content of oxides, measured as ppm oxygen, in the ingot is <3 ppm.

4. The method according to claim 2, wherein the content of oxides, measured as ppm oxygen, in the ingot is ≤0.3 ppm.

5. The method according to claim 2, wherein the content of oxides, measured as ppm oxygen, in the ingot is ≤0.1 ppm.

6. The method according to claim 2, wherein the content of oxides, measured as ppm oxygen, in the ingot is ≤0.01 ppm.

7. The method according to claim 1, wherein a temperature of the steel melt when filling the ingot mold is 1650-1500° C.

8. The method according to claim 1, wherein the initial content of oxides in the steel melt prior to filling the ingot mold, measured as ppm oxygen, in the steel melt is ≥3 ppm.

9. The method according to claim 1, wherein the vacuum vessel comprises a closable opening and wherein the ingot mold is filled by supplying liquid steel melt through the closable opening.

10. The method according to claim 1, wherein the ingot mold is filled while a reduced pressure prevails within the vacuum vessel.

11. The method according to claim 1, wherein stirring of the liquid steel melt is performed such that liquid steel is transported in a direction from the bottom of the ingot mold towards the top of the ingot mold and from the top of the ingot mold towards the bottom of the ingot mold.

12. The method according to claim 1, wherein the stirrer is an electromagnetic stirrer.

13. The method according to claim 1, wherein the steel melt comprises carbon in an amount of 0.01-1.3 wt %.

14. The method according to claim 1, wherein the steel melt at least comprises one or more of the following alloy elements in (wt %): Si: 0-3; Mn: 0-3; Cr: 0-18; Ni: 0-10; V: 0-2; Mo: 0-3; and N: 0-0.4.

15. The method according to claim 1, further comprising removing the steel ingot produced by the method from the ingot mold and subjecting the ingot to at least one additional working step.

16. The method according to claim 15, wherein the at least one additional working step forms a bar, wire, strip, tube, sheet, ring or plate.

17. The method according to claim 1, wherein the ingot is formed of Fe-based steel.

* * * * *